United States Patent [19]

Deruelle

[11] 4,063,870

[45] Dec. 20, 1977

[54] COMBUSTION OF HOT GASES OF LOW CALORIFIC POWER

[75] Inventor: Jean Deruelle, St. Avold, France.

[73] Assignee: Stein Industrie, Velizy-Villacoublay, France

[21] Appl. No.: 628,768

[22] Filed: Nov. 4, 1975

[30] Foreign Application Priority Data

Nov. 6, 1974 France ..... 74.36828

[51] Int. Cl.[2] ..... F23G 7/06; F23L 9/02

[52] U.S. Cl. ..... 431/75; 23/277 C; 431/181; 431/187

[58] Field of Search ..... 23/277 C; 431/5, 10, 431/12, 75, 77, 89, 181, 187, 202

[56] References Cited

U.S. PATENT DOCUMENTS

| | | | |
|---|---|---|---|
| 2,920,689 | 1/1960 | Tinker | 431/10 |
| 3,030,773 | 4/1962 | Johnson | 431/352 X |
| 3,209,811 | 10/1965 | Strang | 431/181 UX |
| 3,676,048 | 7/1972 | Sellors et al. | 431/187 X |
| 3,730,668 | 5/1973 | Iida et al. | 431/10 |
| 3,789,104 | 1/1974 | McCauley | 23/277 C X |
| 3,794,459 | 2/1974 | Meenan | 23/277 C X |
| 3,837,813 | 9/1974 | Ebeling | 431/5 X |
| 3,838,974 | 10/1974 | Hemsath et al. | 23/277 C |
| 3,917,796 | 11/1975 | Ebeling | 431/5 X |

*Primary Examiner*—Alan Cohan
*Assistant Examiner*—Gerald A. Michalsky
*Attorney, Agent, or Firm*—Cushman, Darby & Cushman

[57] ABSTRACT

The complete combustion of hot gases of low calorific power is effected by introducing the gases into a combustion chamber at a pressure close to atmospheric pressure and at a temperature of between 600° and 900° C, by introducing at burner level primary air to a maximum of 80% of the stoichiometric proportion, by supplying secondary air near the base of the flame in an excess relation to the stoichiometric amount so that the flame temperature is between 1,000° and 1,300° C and by discharging the combustion products from the combustion chamber by means of a chimney.

4 Claims, 2 Drawing Figures

3
24
42
25
17
41
α
26
23
18
12
18
10
11
1
22
19
22
4
44
43
20
14
21
13
16
15

COMBUSTION OF HOT GASES OF LOW CALORIFIC POWER

BACKGROUND OF THE INVENTION

1. Field of the Invention

This invention relates to a process for the complete combustion of hot gases of low calorific power, such as reducing smoke of rich gases and by-products of the carbonisation of coal, which gases are available under a pressure close to atmospheric pressure, which process uses at least one burner in a combustion chamber having means for introducing primary air and means for introducing secondary air. The invention also relates to a combustion chamber for carrying out the process.

2. Description of the Prior Art

The by-products of a coal pyrolysis installation, such as a rotary furnace, or a rotary hearth furnace, or a direct-fired furnace, are in a gaseous state and entrain fine solid products, such as carbon black, soot or coal dust, and condensible products such as tars or benzenes.

In conventional pyrolysis processes these by-products are generally subjected to sufficient cooling to achieve complete condensation, thereby making it possible to obtain in the carbonisation plant the negative pressure necessary for applying suction to the by-product with the aid of known means, such as extractor fans. If on the other hand it is desired to burn these by-products immediately at the outlet of the pyrolysis furnace, difficulties are encountered in transferring the gases from the pyrolysis furnace to the combustion furnace, in achieving complete combustion of the suspended particles, and finally in achieving the negative pressure necessary for the extraction of the gases because of the high temperature.

There are innumerable disappointing inventions relating to the collection of charging gases in coke oven plants. In particular, techniques aiming to burn the impurities lead to only very partial results, combustion being incomplete. Furthermore, equipment is periodically destroyed by explosions or local overheating.

A combustion chamber for the combustion of lean gases is known from U.S. Pat. No. 2,920,689. Air for combustion is supplied by a fan and divided into primary air and secondary air which are respectively supplied through valves to nozzles from which they pass out at high speed and with turbulence.

Furthermore, from French Pat. No. 2,193,178 a process is known for the extinction of stoichiometric combustion products by the injection of air with a view to limiting to 525° C the temperature of the gases discharged to the atmosphere. Moreover, an arrangement comprising two combustion chambers followed by an extinction chamber is known from French Pat. No. 2,065,890.

These arrangements have the major disadvantage of entailing the formation of a high-intensity turbulent flame, thereby making it necessary to use expensive refractory materials and to take special precautions against the risk of extinction and explosion, for example by maintaining a pilot flame. Moreover, stoichiometric proportions are difficult to maintain for gases whose calorific power may vary, as is frequently the case with numerous lean gases occuring as by-products of industrial processes, particularly when they contain crackable constituents at high temperature of high calorific power, such as carbon black and higher hydrocarbons.

SUMMARY

The aim of the invention is to propose a process and a combustion chamber making it possible to achieve complete combustion and perfect smoke removal without risk of explosion or damage to the plant, while producing a negative pressure favourable to the collection and evacuation of the gases.

In the process of the invention this aim is achieved through the fact that the gases are introduced into the combustion chamber at the available pressure close to atmospheric pressure and at a temperature between 600° and 900° C, the primary air is introduced at burner level in an amount limited to a maximum of 80% of the stoichiometric proportion, the secondary air is supplied near the base of the flame and in an excess in relation to the stoichiometric amount such that the flame temperature is between 1,000° and 1,300° C, and the combustion products are discharged outside the combustion chamber by means of a chimney.

In this manner it is ensured that the carbon black and the high hydrocarbons will be completely burned thanks to perfect combustion ensuring good consumption of smoke. This result is interesting when it is known that it is difficult to achieve complete combustion of crackable products having high calorific power when they are mixed with considerable gaseous ballast. Combustion is achieved practically without turbulence.

It is advantageous to introduce the gases into the combustion chamber at a temperature of about 750° C and to adjust the flame temperature to about 1,100° C.

An advantageous expedient is to introduce a part of the secondary air through apertures arranged to effect cooling by bathing the walls of the combustion chamber.

In this way it is possible to obtain high combustion temperatures without having to make the combustion chamber of expensive refractory material. The combination of the bathing of the walls by fresh air and the absence of turbulence is in fact very favourable for maintaining a low wall temperature.

The combustion chamber according to the invention comprises in combination:

a vertical wall connected at the top to a chimney;

a base plate in which is disposed at least one burner comprising a nozzle supplying gas at a pressure close to atmospheric and means of supplying forced primary air for combustion, the said base plate in addition being provided with peripheral nozzles directed towards a point situated above the burner and having means of supplying forced secondary air for combustion; control means controlling the flow of air for combustion in dependence on the temperature of the upper portion of the chamber, and control means controlling the distribution of primary and secondary air flows in dependence on the temperature of the flame.

In this way, the secondary air forms a kind of arch surrounding the flame and effects perfect smoke-consuming combustion.

It is advantageous for the base plate to be provided in addition with vertical peripheral apertures admitting air for bathing the vertical walls, and for the base plate to have a projection surrounding the peripheral nozzles of the burners.

DESCRIPTION OF THE PREFERRED EMBODIMENT

Figure 1:
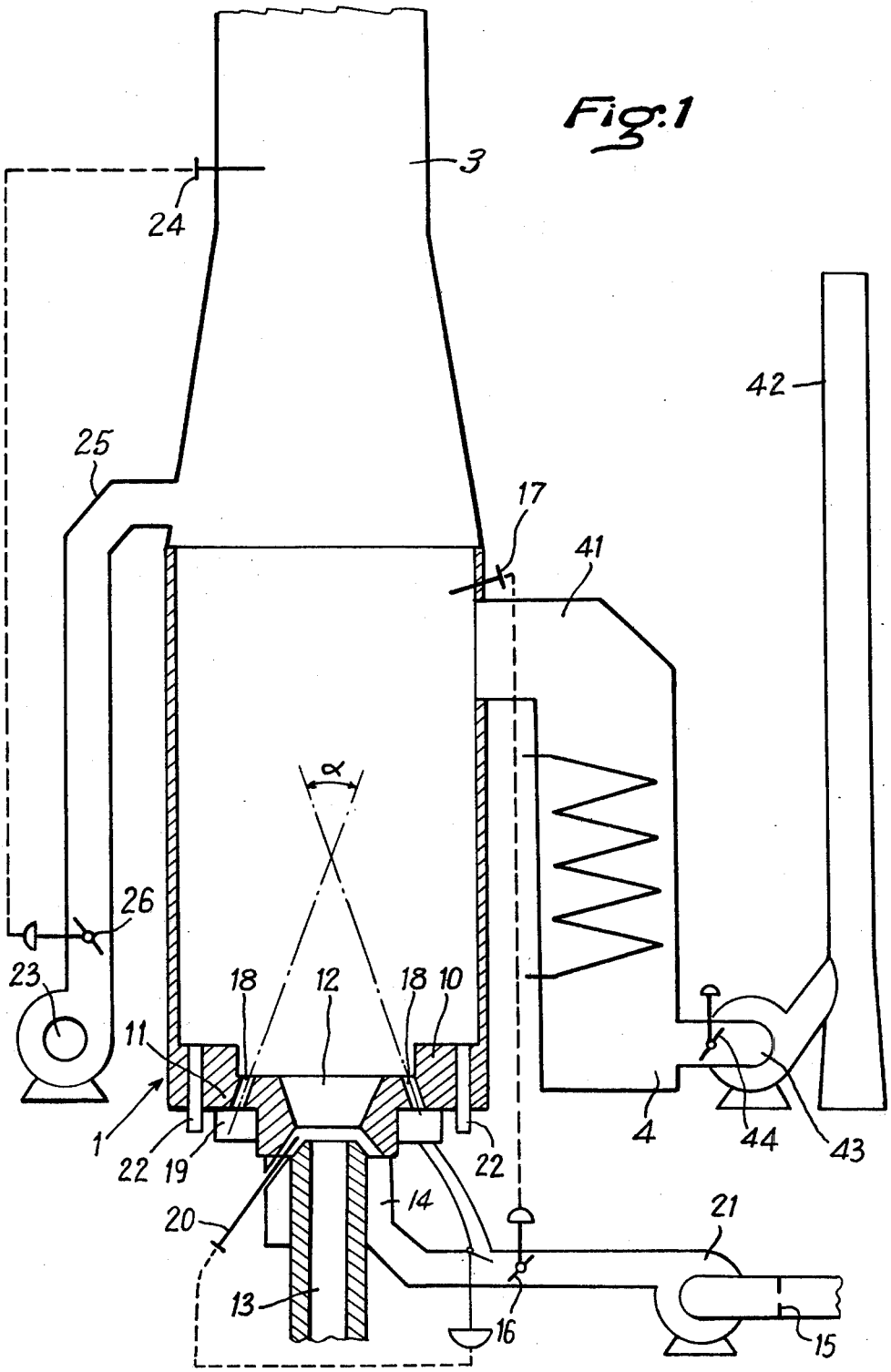
FIG. 1 is a vertical axial section of a combustion chamber according to the invention and which contains a single burner.

Referring to FIG. 1, there is illustrated a combustion chamber which has vertical walls and which is given the general reference 1, this chamber being connected at the top to a natural draught chimney 3. A burner 12 and air inlet 14 are disposed in the base plate 11 of the chamber 1, as will be explained below.

A pipe (not shown) supplies hot gases having low calorific power to the nozzle 13 of the burner 12 which includes the air inlet duct 14 supplying primary air for combustion delivered by a an 21, the flow of which is measured by a diaphragm 15 and is regulated by a damper 16 controlled by first regulating means shown as a thermocouple 17 measuring the temperature at the top of the chamber 1, which is connected to the chimney 3.

The secondary air is introduced into the chamber through oblique convergent nozzles 18 directed towards the flame appearing at the tip of the burner 12. The Applicant's experience has shown that an angle $\alpha$ close to 40° is advantageous. The nozzles 18 are supplied with air by means of a wind box 19, which in turn is fed with air by a fan (not shown) or by a branch of the primary air supply pipe, this branch being adjustable by means of a damper.

In either case the flow of secondary air is controlled by second regulating means shown as a thermocouple 20.

The control means effect regulation in such a manner that the conditions previously indicated for the definition of the main characteristic of the invention are achieved, that is to say for introduction of the gases at a temperature between 600° and 800° C; primary air limited to 80% of the stoichiometric proportion, an excess of secondary air such that the flame temperature is between 1,000° and 1,300° C. Preferred adjustments will be 750° C for the admission temperature and 1,100° C for the flame temperature. A peripheral projection 10 surrounds the nozzles 18 and improves the directivity of the secondary air.

A further quantity of secondary air may be introduced into the combustion chamber 1 through apertures 22 distributed around the periphery of the base plate 11. These apertures 22 are disposed vertically, so that the air which passes through them passes into the combustion chamber 1 so as to bathe the vertical walls of the chamber 1 and thus cool them. It is advantageous for the apertures 22 to be adjustable. It is preferable for the air to enter the apertures 22 under the action of the negative pressure prevailing in the chamber. Alternatively, the air can be supplied to the apertures 22 by means of a fan or of a branch from the wind box 19.

A fan 23 makes is possible to blow cold air through a pipe 25 at the base of the chimney 3 so that, by adjusting a damper 26 controlled by a thermocouple 24, an outlet temperature of the chamber lower than 600° C can be obtained.

A heat exchanger 4 makes it possible to use the sensible heat of the smoke during at least part of the operating periods. To this end it is possible to produce a forced circulation through the heat exchanger 4 by means of a branch pipe 41, with the aid of an exhaust fan 43 provided with a damper 44 controlled by the thermocouple 24 and finally through an independent chimney 42.

The installation may be completed by any usual subsidiary devices, for example starting burners (not shown) to enable the combustion chamber to reach its operating temperature, flame detection cells, and any other usual safety device.

The process may be applied to gases such as those defined in the preamble, without this constituting a limitation; it may for example advantageously be applied to the gases coming from a coal pyrolysis plant carrying out the process described in French Pat. application No. 74,22402 of the 27th June, 1974, having the title "Process for the production of pulverulent coke and reactive coke in grains", the U.S. counterpart of whch is Deruelle et al application Ser. No. 588,172, filed June 18, 1975.

Experiments carried out by the Applicant surprisingly show that, when applied to pyrolysis gases at 750° C which are obtained from the process mentioned above, the process of the invention makes it possible to obtain at the outlet of the chimney 3 an exhaust to the atmosphere which is practically invisible and is even invisible in a wreath of water vapour.

In this case the gases had a net calorific value, including sensible heat, of 2600 kcal/kg at 750° C. The thermal load of the chamber attained 25000 th/h, and produced in the gas supply pipe a negative pressure of about 2 millibars for a negative pressure of the combustion chamber of 3 millibars. The combustion conditions were very stable with a primary air flow of 18,000 cubic meters per hour, a central secondary air flow of 22,000 cubic meters per hour, and a peripheral secondary air flow of 20,000 cubic meters per hour.

Figure 2:
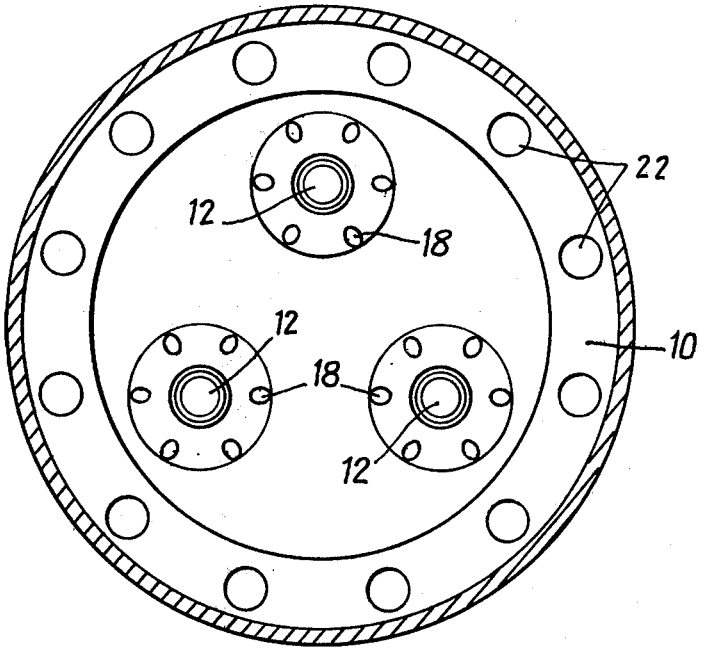
FIG. 2 is a plan view of the base plate of an alternative combustion chamber according to the invention and which contains three burners.

FIG. 2 shows a variant of the apparatus illustrated in FIG. 1, comprising three burners 12. The same reference numerals designate the same parts as in FIG. 1.

It will be observed that the process utilizes an internal regulation arrangement which it would appear helpful to recapitulate:

The air for combustion is regulated by the first regulating means 17 in dependence on the temperature measured in the top part of the combustion chamber;

The distribution between primary air and secondary air in the burner is regulated by the second regulating means 20 in dependence on the temperature of the flame. In practice it will be easy to regulate it in dependence on the temperature radiated at burner level onto the walls, this temperature being taken as image temperature of the flame temperature;

The secondary air bathing the walls is preferably regulated by action on the base plate apertures in such a manner that the two previously mentioned regulations remain within a good operating range;

In the case of recuperation of the sensible heat of the smoke, the thermal load of the arrangement is regulated by action on the damper of the exhaust fan.

Finally, the particular advantages obtained by operating in accordance with the invention should be noted: Complete or partial recuperation of the latent or sensible calories of low-value gaseous by-products is effected, while creating a utilisable negative pressure in their circuit;

These gaseous by-products, which are naturally dirty and polluting, can be burned by recuperating the heat in large capacity units giving rise to remarkably little or even to no pollution.

In an alternative of the smoke circuit it is possible to produce the entire draught through the heat exchanger 4 by means of the exhaust fan 43. In this case, the chimney is a forced draught chimney, all the smoke from the combustion chamber 1 being drawn into the heat exchanger 4. In this alternative the flame temperature will be advantageously adjusted at 1200° C.

I claim:

1. A combustion chamber for the complete combustion of hot gases of low calorific value, comprising:

a. a chamber having a vertical wall, a base and top, said vertical wall disposed between said base and top, b. a chimney connected to the top of the wall for the discharge of combustion productions from the chamber, c. a base plate associated with the base of said chamber, d. at least one burner upwardly directed associated with the base plate and having a nozzle arranged to supply gas at a pressure close to atmospheric pressure and means for force supplying said primary air, e. said base plate including for each of said at least one burner, peripheral oblique convergent nozzles directed to a point situated above the burner and comprising means for force supplying said secondary air, f. distribution means for distribution of combustion air flow in two parts, one part directed to the burner and the other part to the peripheral nozzles, g. first regulating means operable to control the flow of air for combustion depending on the temperature in the vicinity of the top of the chamber, and second regulating means operable to control the distribution of the flow of primary air and the flow of secondary air depending on the flame temperature.

2. A combustion chamber according to claim 1, wherein the base plate includes vertical peripheral apertures arranged to admit to the chamber air arranged to bath the vertical wall.

3. A combustion chamber according to claim 2, wherein the base plate includes a projection surrounding the peripheral nozzles.

4. The combustion chamber of claim 1, wherein said second regulating means causes said secondary air to form substantially an arch surrounding the flame and to affect substantially perfect smoke-consuming combustion.

* * * * *